US008845357B2

(12) United States Patent
Gong et al.

(10) Patent No.: US 8,845,357 B2
(45) Date of Patent: Sep. 30, 2014

(54) SECURING DEVICE FOR SECURING PLUG OF TRANSMISSION CABLE WITH CONNECTOR

(71) Applicant: Silicon Video Systems, Inc., Hsinchu County (TW)

(72) Inventors: Morris Gong, Hsinchu County (TW); Hui-Chien Fu, Hsinchu County (TW); Wen-Hung Tu, Hsinchu County (TW)

(73) Assignee: Silicon Video Systems, Inc., Hsinchu County (TW)

( * ) Notice: Subject to any disclaimer, the term of this patent is extended or adjusted under 35 U.S.C. 154(b) by 30 days.

(21) Appl. No.: 13/773,644

(22) Filed: Feb. 22, 2013

(65) Prior Publication Data

US 2014/0242828 A1 Aug. 28, 2014

(51) Int. Cl.
*H01R 13/625* (2006.01)
*H01R 13/627* (2006.01)

(52) U.S. Cl.
CPC ..... *H01R 13/6275* (2013.01)
USPC ..... 439/357

(58) Field of Classification Search
USPC ..... 439/357, 352, 607.01, 607.41, 661, 92, 439/353, 358; 385/92
See application file for complete search history.

(56) References Cited

FOREIGN PATENT DOCUMENTS

TW M277156 10/2005

*Primary Examiner* — Alexander Gilman
(74) *Attorney, Agent, or Firm* — C. G. Mersereau; Nikolai & Mersereau, P.A.

(57) ABSTRACT

A securing device includes a first closing unit and a second closing unit. The first closing unit with two upward guide portions and a resilient pressing portion. A protrusion extends from the top of the resilient pressing portion. A fixing portion is connected to the second end of the first closing unit is formed by a wire bending downward from the second end of the first closing unit so as to be mounted to the transmission cable. The second closing unit is a box-like unit. An opening is defined through in the second closing unit so as to accommodate the first closing unit therein. A plurality of engaging holes are defined through the top of the second closing unit and the protrusion of the first closing unit is engaged with one of the engaging holes.

10 Claims, 5 Drawing Sheets

SECURING DEVICE FOR SECURING PLUG OF TRANSMISSION CABLE WITH CONNECTOR

BACKGROUND OF THE INVENTION (1) Field of the Invention

The present invention relates to a securing device, and more particularly, to a securing device for securing a plug having a high definition multimedia interface (HDMI) transmission cable with a connector.

(2) Description of the Prior Art

The conventional way for connecting the male part (so called as a plug) of a cable with a female part (so called as a connector) is using a screw. However, the modern plug and connector have only limited space for the screw which is difficult to easily connect the plug with the connector. Taiwan Utility Model number M277156 discloses that a securing device which has a hook unit on the male part and an engaging member on the female part. The hook unit has a hook which is movable relative to the male part, and the engaging member has an engaging portion which is movable and is engaged with the hook. The male part is secured to the female part when the hook is engaged with the engaging portion.

However, the above mentioned design can only is used for a male part having fixed size, when cooperated with a female part of different size, the male part cannot be successfully connected to the female part. The expense is increased when the users prepare different sizes of the male and female parts. Besides, the male part with the hook is not a standard part which cannot be cooperated with the existed transmission cables.

Furthermore, there is no proper guidance design for guiding the connection between the engaging portion and the hook. When assembling, the users may not easily and successfully connect the male and female parts.

SUMMARY OF THE INVENTION

The present invention intends to provide a securing device for securing a plug having an HDMI transmission cable with a connector, and the securing device has simplified structure and is easily operated.

The present invention relates to a securing device for securing a plug having a transmission cable with a connector, and comprises a first closing unit and a second closing unit. The first closing unit has two sides and bends the sides to form at least one of guide portion. The securing device further comprises a resilient pressing portion, a protrusion, and fixing portion. The resilient pressing portion extends upward from the first end of the first closing unit and toward the second end of the first closing unit. The protrusion extends from the top of the resilient pressing portion. The fixing portion is connected to the second end of the first closing unit and the fixing portion is formed by a wire bending downward from the second end of the first closing unit. The second closing unit is a box-like unit and has two sidewalls extending from two sides thereof. The second closing unit further comprises a tapped hold, an opening, two sidewalls, and a plurality of engaging holes. The tapped hole is defined through the first end of the second closing unit. The opening is defined through the second end of the second closing unit. The two sidewalls extend from two sides of the second closing unit and the height of each sidewall is sized to be higher than the height of each guide portion of the first closing unit. The plurality of engaging holes are defined through the top of the second closing unit and the protrusion of the first closing unit is engaged with one of the engaging holes.

Alternatively, the present invention also provides to a securing device for securing a plug having a transmission cable with a connector, and comprises a first closing unit and a second closing unit. The first closing unit has two upward guide portions on two sides and bending the sides to form at least one of guide portion. The first closing unit further comprises a resilient pressing portion, a protrusion, and a fixing portion. The resilient pressing portion extends upward from the first end of the first closing unit and toward the second end of the first closing unit. The protrusion extends from the top of the resilient pressing portion. The fixing portion is connected to the second end of the first closing unit and the fixing portion is formed by a wire bending downward from the second end of the first closing unit. The fixing portion has a mounting recessed at the intermediate portion thereof. The mounting recessed accommodates the transmission cable. A second closing unit is a box-like unit and has two sidewalls extending from two sides thereof. A tapped hole is defined through the first end of the second closing unit and an opening is defined through the second end of the second closing unit. Two sidewalls extend from two sides of the second closing unit and the height of each sidewall is sized to be higher than the height of each guide portion of the first closing unit. A plurality of engaging holes are defined through the top of the second closing unit and the protrusion of the first closing unit is engaged with one of the engaging holes.

The present invention has a guiding function and a securing function for easily assembling and using. The present invention can reach an effect of cost down.

DETAILED DESCRIPTION OF THE PREFERRED EMBODIMENT

The present invention will become more obvious from the following description when taken in connection with the accompanying drawings which show, for purposes of illustration only, a preferred embodiment in accordance with the present invention.

Figure 1:
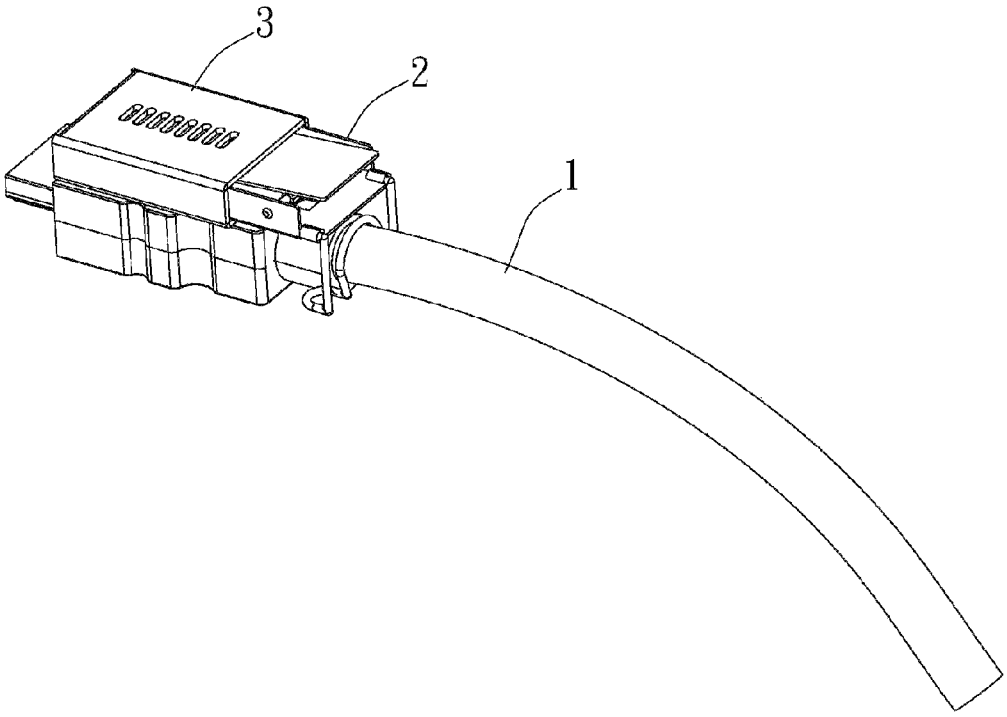
FIG. 1 is a perspective view to show the securing device of the present invention.
Figure 2:
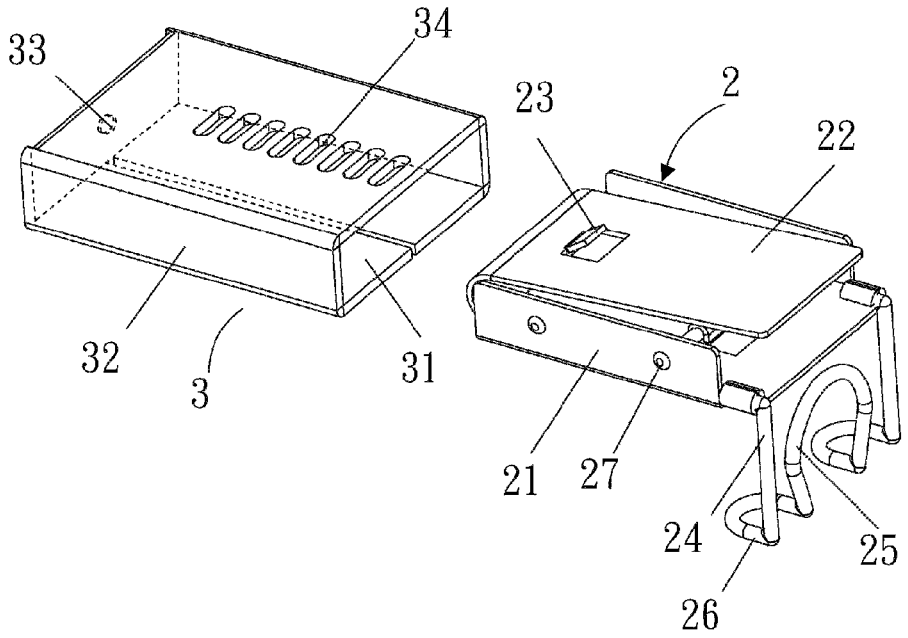
FIG. 2 shows a first closing unit and a second closing unit of a securing device of the present invention.

Referring to FIGS. 1 and 2, the securing device of the present invention is used to connect the plug 1 having a transmission cable with a connector (not shown), and comprises a first closing unit 2 having two upward guide portions 21 on two sides thereof. A resilient pressing portion 22 extends upward from the first end of the first closing unit 2 and toward the second end of the first closing unit 2. A protrusion 23 extends from the top of the resilient pressing portion 22. A fixing portion 24 is connected to the second end of the first closing unit 2 and the fixing portion 24 is formed by a wire bending downward from the second end of the first closing unit 2.

A second closing unit 3 is a box-like unit and has two sidewalls 32 extending from two sides thereof. A tapped hole 33 is defined through the first end of the second closing unit 3 and an opening 31 is defined through the second end of the second closing unit 3. Two sidewalls 32 extend from two sides of the second closing unit 3 and the height of each sidewall 32 is sized to be higher than the height of each guide portion 21 of the first closing unit 2, so that the first closing unit 2 is inserted into the second closing unit 3 from the opening 31. A plurality of engaging holes 34 are defined through the top of the second closing unit 3 and the protrusion 23 of the first closing unit 2 is engaged with one of the engaging holes 34. The fixing portion 24 has a mounting recessed 25 at the intermediate portion thereof so that the mounting recessed 25 accommodates the transmission cable. The fixing portion 24 has at least one leg 26 extending toward the first end of the first closing unit 2. The plug 1 on the transmission cable is a high definition Multimedia Interface (HDMI) plug and the connector (not shown) is an HDMI connector. The second closing unit 3 is fixed to the connector by using a screw via the tapped hole 33. Each of the guide portions 21 of the first closing unit 2 has a plurality of bosses 27 extending therefrom so as to reduce friction when the first closing unit 2 is inserted into the second closing unit 3.

Figure 3:
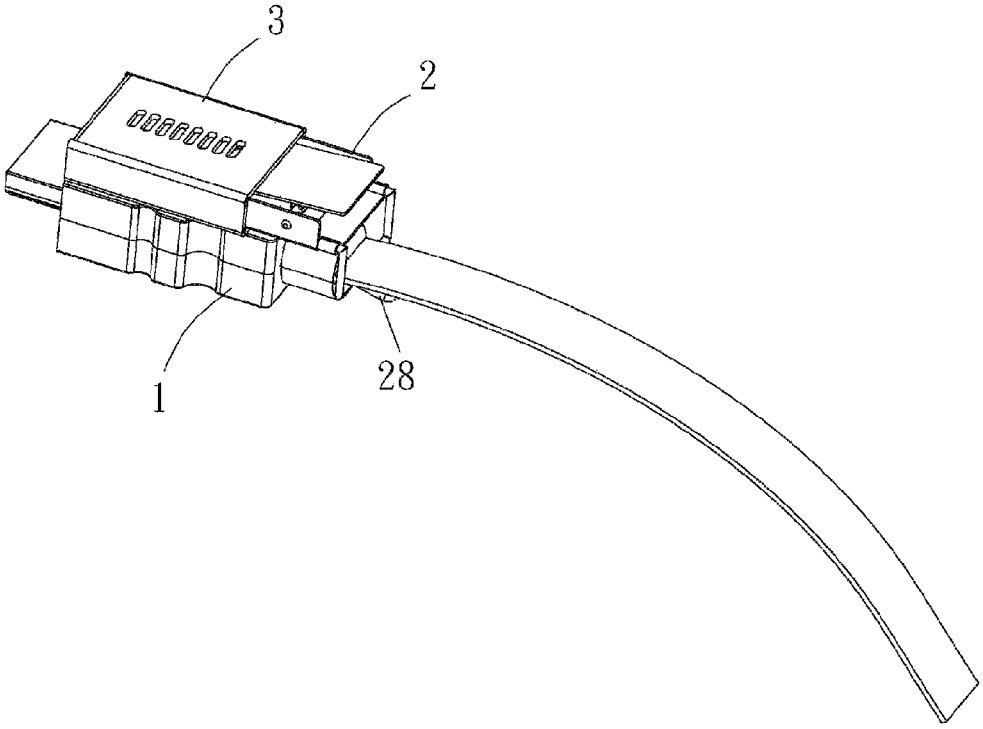
FIG. 3 is a perspective view to show a second embodiment of a securing device of the present invention.
Figure 4:
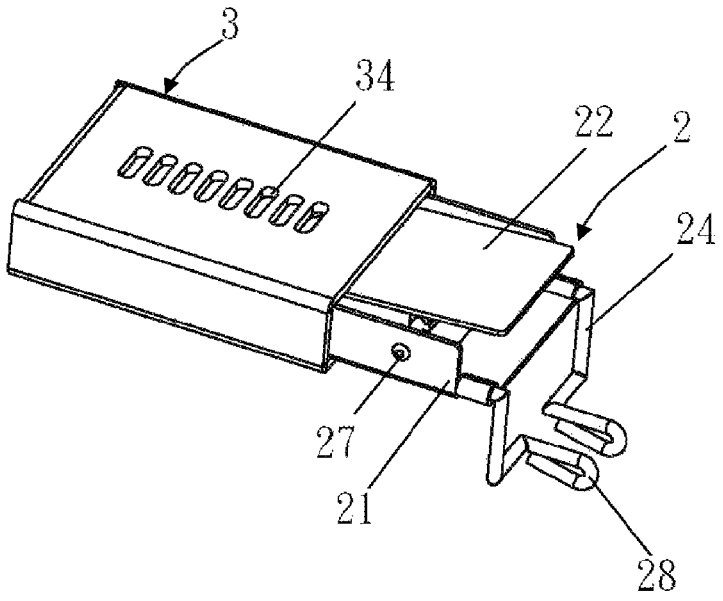
FIG. 4 shows that a first closing unit and a second closing unit of the second embodiment of a securing device of the present invention are connected to each other.

FIGS. 3 and 4 show a second embodiment of the present invention, the difference of the second embodiment from the first embodiment is that there is no at least one leg 26 in FIG. 2 formed on the fixing portion 24, and the fixing portion 24 has at least one support 28 extending toward the second end of the first closing unit 2.

Figure 5:
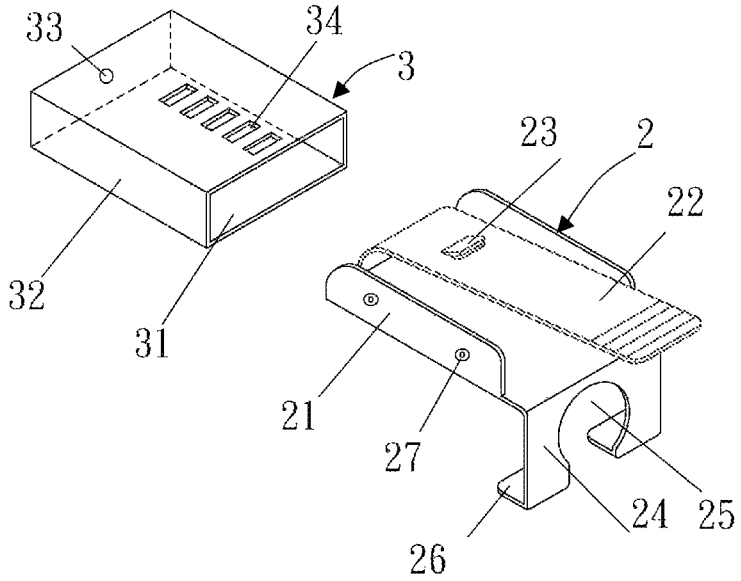
FIG. 5 shows a first closing unit and a second closing unit of a third embodiment of the securing device of the present invention.

FIG. 5 is a third embodiment of the securing device which comprises a first closing unit 2 having two upward guide portions 21 on two sides thereof. A resilient pressing portion 22 extends upward from the first end of the first closing unit 2 and toward the second end of the first closing unit 2. A protrusion 23 extends from the top of the resilient pressing portion 22. A fixing portion 24 is connected to the second end of the first closing unit 2 and the fixing portion 24 is formed by a wire bending downward from the second end of the first closing unit 2. The fixing portion 24 has a mounting recessed 25 at the intermediate portion thereof. A second closing unit 3 is a box-like unit and has two sidewalls 32 extending from two sides thereof. A tapped hole 33 is defined through the first end of the second closing unit 3 and an opening 31 is defined through the second end of the second closing unit 3. Two sidewalls 32 extend from two sides of the second closing unit 3 and the height of each sidewall 32 is sized to be higher than the height of each guide portion 21 of the first closing unit 2, so that the first closing unit 2 is inserted into the second closing unit 3 from the opening 31. A plurality of engaging holes 34 are defined through the top of the second closing unit 3 and the protrusion 23 of the first closing unit 2 is engaged with one of the engaging holes 34 so as to adjust the relative position between the first closing units 2 and the second closing units 3. The mounting recessed 25 is formed at the intermediate portion of the fixing portion 24 so that the transmission cable is engaged with the mounting recessed 25. The fixing portion 24 has at least one leg 26 extending toward the first end of the first closing unit 2. The plug 1 having the transmission cable is a high definition Multimedia Interface (HDMI) plug and the connector (not shown) is an HDMI connector. The second closing unit 3 is fixed to the connector by using a screw via the tapped hole 33. Each of the guide portions 21 of the first closing unit 2 has a plurality of bosses 27 extending therefrom so as to reduce friction when the first closing unit 2 is inserted into the second closing unit 3.

While we have shown and described the embodiment in accordance with the present invention, it should be clear to those skilled in the art that further embodiments may be made without departing from the scope of the present invention.

What is claimed is:

1. A securing device for securing a plug having a transmission cable with a connector, and the securing device comprising:

a first closing unit having two sides and bending the sides to form at least one of guide portion, a resilient pressing portion extending upward from a first end of the first closing unit and toward a second end of the first closing unit, a protrusion extending from a top of the resilient pressing portion, a fixing portion connected to the second end of the first closing unit and the fixing portion being formed by a wire bending downward from the second end of the first closing unit, and a second closing unit being a box-like unit and having two sidewalls extending from two sides thereof, a tapped hole defined through a first end of the second closing unit and an opening defined through a second end of the second closing unit, two sidewalls extending from two sides of the second closing unit and a height of each sidewall being sized to be higher than a height of each guide portion of the first closing unit, a plurality of engaging holes defined through a top of the second closing unit and the protrusion of the first closing unit engaged with one of the plurality of engaging holes.

2. The securing device as claimed in claim 1, wherein the fixing portion has a mounting recessed at an intermediate portion thereof, the mounting recessed is adapted to accommodate the transmission cable.

3. The securing device as claimed in claim 2, wherein the fixing portion has at least one of leg extending toward the first end of the first closing unit.

4. The securing device as claimed in claim 1, wherein the fixing portion has at least one support extending toward the second end of the first closing unit.

5. The securing device as claimed in claim 1, wherein the second closing unit is adapted to be connected to the connector via the tapped hole.

6. The securing device as claimed in claim 1, wherein each of the guide portions of the first closing unit has a plurality of bosses extending therefrom.

7. A securing device for securing a plug having a transmission cable with a connector, and comprising:

a first closing unit having two sides and bending the sides to form at least one of guide portion, a resilient pressing portion extending upward from a first end of the first closing unit and toward a second end of the first closing unit, a protrusion extending from a top of the resilient pressing portion, a fixing portion connected to the second end of the first closing unit and the fixing portion being formed by a wire bending downward from the second end of the first closing unit, the fixing portion having a mounting recessed at an intermediate portion thereof, the mounting recessed adapted to accommodate the transmission cable, and a second closing unit being a box-like unit and having two sidewalls extending from two sides thereof, a tapped hole defined through a first end of the second closing unit and an opening defined through a second end of the second closing unit, two sidewalls extending from two sides of the second closing unit and a height of each sidewall being sized to be higher than a height of each guide portion of the first closing unit, a plurality of engaging holes defined through a top of the second closing unit and the protrusion of the first closing unit engaged with one of the plurality of engaging holes.

8. The securing device as claimed in claim 7, wherein the fixing portion has at least one of leg extending toward the first end of the first closing unit.

9. The securing device as claimed in claim 7, wherein the second closing unit is adapted to be connected to the connector via the tapped hole.

10. The securing device as claimed in claim 7, wherein each of the guide portions of the first closing unit has a plurality of bosses extending therefrom.

* * * * *